US006143101A

United States Patent [19]

Lundstrom

[11] Patent Number: 6,143,101

[45] **Date of Patent: *Nov. 7, 2000**

[54] CHLORATE-FREE AUTOIGNITION COMPOSITIONS AND METHODS

[75] Inventor: Norman H. Lundstrom, Manassas, Va.

[73] Assignee: Atlantic Research Corporation, Gainesville, Va.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/359,048

[22] Filed: Jul. 23, 1999

[51] Int. Cl.[7] ..... C06B 47/08; C06B 33/00; C06B 31/00; C06B 31/02; C06B 45/10

[52] U.S. Cl. ..... 149/36; 149/37; 149/45; 149/61; 149/19.1; 149/19.5; 149/76; 280/740; 280/741

[58] Field of Search ..... 149/36, 45

[56] References Cited

U.S. PATENT DOCUMENTS

| | | | |
|---|---|---|---|
| 3,063,880 | 11/1962 | Deger et al. | 149/18 |
| 3,095,334 | 6/1963 | Scurlock | 149/21 |
| 3,586,551 | 6/1971 | Nolan | 149/2 |
| 3,706,608 | 12/1972 | Geisler | 149/6 |
| 3,819,380 | 6/1974 | Baldassarri et al. | 96/76 R |
| 3,844,855 | 10/1974 | Plomer et al. | 149/36 |
| 3,966,516 | 6/1976 | Sakai et al. | 149/60 |
| 4,023,352 | 5/1977 | Sayles | 149/36 |
| 4,029,702 | 6/1977 | Piccolini | 564/35 |
| 4,561,675 | 12/1985 | Adams et al. | 280/734 |
| 4,806,180 | 2/1989 | Goetz et al. | 149/5 |
| 4,948,439 | 8/1990 | Poole et al. | 149/46 |
| 5,035,757 | 7/1991 | Poole | 149/46 |
| 5,084,118 | 1/1992 | Poole | 149/22 |
| 5,324,075 | 6/1994 | Sampson | 280/736 |
| 5,380,380 | 1/1995 | Poole et al. | 149/22 |
| 5,399,555 | 3/1995 | Vandevelde et al. | 514/150 |
| 5,411,615 | 5/1995 | Sumrail et al. | 149/47 |
| 5,460,671 | 10/1995 | Khandhadia | 149/109.6 |
| 5,557,062 | 9/1996 | MacLaren et al. | 149/46 |
| 5,656,793 | 8/1997 | Ochi et al. | 149/36 |
| 5,739,460 | 4/1998 | Knowlton et al. | 102/324 |
| 5,763,821 | 6/1998 | Wheatley | 149/19.5 |
| 5,811,725 | 9/1998 | Klager | 149/19.4 |
| 5,850,053 | 12/1998 | Scheffee et al. | 149/19.91 |
| 5,861,571 | 1/1999 | Scheffee et al. | 102/288 |
| 5,866,842 | 2/1999 | Wilson et al. | 149/19.6 |
| 5,883,330 | 3/1999 | Yoshida | 149/36 |
| 6,017,404 | 1/2000 | Lundstrom et al. | 149/36 |

*Primary Examiner*—Charles T. Jordan
*Assistant Examiner*—Glenda L. Sánchez
*Attorney, Agent, or Firm*—Nixon & Vanderhye P.C

[57] ABSTRACT

Chlorate-free autoignition compositions are disclosed, and may be embodied in compositions comprised of (i) an azodiformamidine dinitrate (ADFD), a self-deflagrating, low ignition temperature fuel, (ii) an oxidizer (e.g., a perchlorate, nitrate or mixture thereof) and (iii) an ignition accelerator/augmentor (e.g., a metal or metal oxide powder). One especially preferred solid AIP composition in accordance with the present invention includes ADFD, a mixture of ammonium perchlorate and sodium nitrate, an iron oxide powder and a binder, such as a poly(alkylene carbonate).

22 Claims, No Drawings

CHLORATE-FREE AUTOIGNITION COMPOSITIONS AND METHODS

FIELD OF THE INVENTION

The present invention relates generally to inflators for devices such as protective passive restraints or air bags used in motor vehicles, escape slide chutes, life rafts, and the like. More particularly, the present invention relates to an igniter for gas-generative compositions used in inflator devices and to methods of lowering the ignition temperature of an igniter to below its auto-ignition temperature.

BACKGROUND AND SUMMARY OF THE INVENTION

Many devices, such as protective passive restraints or air bags used in motor vehicles, escape slide chutes, life rafts, and the like, are normally stored in a deflated state and are inflated with gas substantially instantaneously at the time of need. Such devices are generally stored and used in close proximity to humans and, therefore, must be designed with a high safety factor which is effective under all conceivable ambient conditions.

Inflation is sometimes accomplished solely by means of a gas generative composition. At other times, inflation is accomplished by means of a gas, such as air, nitrogen, carbon dioxide, helium, and the like, which is stored under pressure and further pressurized and supplemented at the time of use by the addition of high temperature combustion gas products produced by the burning of a gas-generative composition.

It is, of course, critical that the gas-generative composition be capable of safe and reliable storage without decomposition or ignition at temperatures which are likely to be encountered in a motor vehicle or other storage environment. For example, temperatures as high as about 107° C. (225° C.) may reasonably be experienced. It is also important that substantially all the combustion products generated during use be non-toxic, non-corrosive, non-flammable, particularly where the inflator device is sued in a closed environment, such as a passenger compartment of a motor vehicle.

Igniters are well known in the art for igniting gas-generative compositions in inflators for protective passive restraints used in motor vehicles. In a typical inflator device, the igniter itself may be ignited either directly, or indirectly via an intermediate or auxiliary igniter, by an electrically activated initiator (e.g., squib) which is responds to a sensed impact of the motor vehicle.

Due to the emphasis on weight reduction for improving fuel mileage in motor vehicles, inflator units are often formed form light weight materials, such as aluminum, that can lose strength and mechanical integrity at temperatures significantly above the normal operating temperature of the unit. Although the temperature required for the unit to lose strength and mechanical integrity is much higher than will be encountered in normal vehicle use, these temperatures are readily reached in, for example, a vehicle fire. As the operating pressure of the standard pyrotechnics increases with increasing temperature, a gas generator composition at its autoignition temperature will produce an operating pressure that is too high for a pressure vessel that was designed for minimum weight. Moreover, the melting point of many gas generator compositions is low enough for the gas generator composition to be molten at the autoignition temperature of the composition, which can result in a loss of ballistic control and excessive operating pressures.

Therefore, in a vehicle fire, for example, the ignition of the gas generator composition can result in an explosion in which fragments of the inflation unit are propelled at dangerous and potentially lethal velocities.

To prevent such explosions, inflator units have typically been provided with an autoignition propellant (sometimes abbreviated hereinafter as "AIP") that will autoignite and initiate the combustion of the main gas generating pyrotechnic charge at a temperature below that at which the shell or housing of the inflator unit begins to soften and lose structural integrity.

The art is replete with various proposals for AIP compositions such as those described in U.S. Pat. Nos. 4,561,675; 5,084,118; 5,380,380; 5,460,671; 5,739,460 and 5,763,821 (the entire content of each such prior-issued U.S. Patent being incorporated hereinto expressly by reference). Such conventional AIP compositions, however, typically include chlorate compounds, usually in the form of an alkali or alkaline earth metal chlorate (e.g., $KClO_3$) as an oxidizer. Such chlorate oxidizers are, however, undesirable in some pyrotechnic formulations due to their high degree of sensitivity and incompatibility with other formulation components, especially where the potential for formation of ammonium chlorate exists.

Thus, it would be desirable if an AIP composition could be provided which satisfies the need to reduce the ignition temperature of the propellant composition below its autoignition temperature while, at the same time, exhibits a high degree of stability and compatibility. It is towards fulfilling such needs that the present invention is directed.

Broadly, the present invention is directed to substantially chlorate-free autoignition compositions. More specifically, the present invention is preferably embodied in substantially chlorate-free autoignition compositions comprised of (i) an azodiformamidine dinitrate (ADFD), a novel self-deflagrating, low ignition temperature fuel, (ii) an oxidizer (e.g., a perchlorate, nitrate or mixture thereof) and (iii) an ignition accelerator/augmentor (e.g., a metal or metal oxide powder). One especially preferred AIP composition in accordance with the present invention includes ADFD, a mixture of ammonium perchlorate and sodium nitrate and an iron oxide powder.

These, as well as other, aspects and advantages of the present invention will become more clear from the following detailed description of the preferred exemplary embodiments thereof which follows.

DETAILED DESCRIPTION OF THE INVENTION

The preferred AIP compositions in accordance with the present invention will necessarily include ADFD, a novel self-deflagrating fuel, which has a low ignition temperature, in admixture with an oxidizer and an ignition accelerator/augmentor for providing hot incandescent particles for ignitability of the main propellant charge. The oxidizer may, for example, be a perchlorate (e.g., ammonium perchlorate), a nitrate such as an alkali metal nitrate (e.g., sodium nitrate) and mixtures thereof.

Most preferably, the ADFD will be present in an amount, based on the total AIP composition weight, of between about 60–75 wt. %, most preferably about 70 wt. %. The oxidizer will be present in an amount between about 20–30 wt. %, preferably about 25 wt. %, while the accelerator/augmentor will be present in an amount of between about 3–10 wt. %, preferably about 5 wt. %.

When a mixture of perchlorate (e.g., ammonium perchlorate) and nitrate (e.g., sodium nitrate) is employed as the oxidizer component, then each will be present in an amount between about 10 to about 15 wt. %. For example, when both ammonium perchlorate and sodium nitrate are present, then the ammonium perchlorate is present in an amount of about 14 wt. % while the ammonium nitrate is present in an amount of about 10 wt. %.

An ignition accelerator/augmentor in the form of a powdered metal or metal oxide will also be present in the compositions of the present invention. The metal or metal oxide powder that may be used as an ignition accelerator/augmentor in conjunction with the ADFD in accordance with the present invention includes, for example, iron oxide, copper oxide, magnesium, aluminum, tungsten, titanium, zirconium and hafnium. Boron potassium nitrate ($BKNO_3$) may also be employed as an ignition accelerator/augmentor. These ignition accelerators/augmentors may be used singly, or in admixture with one or more other ignition accelerator/augmentors. One particularly preferred ignition accelerator/augmentor when used in conjunction with ADFD is superfine iron oxide powder commercially available from Mach I Corporation of King of Prussia, Pa. as NANOCAT® superfine iron oxide material. This preferred iron oxide powder has an average particle size of about 3 nm, a specific surface density of about 250 $m^2g$, and bulk density of about 0.05 gm/ml.

The AIP compositions may be used in the form of powders, granules, or compression-molded pellets. The AIP compositions are most preferably used in the form of a solid compression-molded mixture of the above-noted components. In this regard, the compositions will therefore most preferably include a polymeric binder in an amount sufficient to bind the components into a solid form (e.g., pellet). The binder will therefore typically be present in an amount, based on the total AIP composition weight, of between about 1.0 to about 5.0 wt. %, and preferably about 2.0 wt. %. The preferred binders include poly(alkylene carbonates) that are commercially available from Pac Polymers, Inc. as Q-PAC® 40, a poly(propylene carbonate) copolymer, and Q-PAC® 25, a poly(ethylene carbonate) copolymer, or mixtures thereof.

One particularly preferred AIP composition in accordance with the present invention is as follows:

| Ingredient | Amt. (wt. %) |
|---|---|
| ADFD | 69.46 |
| ammonium perchlorate | 13.85 |
| sodium nitrate | 10.03 |
| iron oxide (NANOCAT ®) | 4.76 |
| polypropylene carbonate binder (Q-PAC ® 40) | 1.90 |

The composition above exhibits exceptionally high thermal stability (i.e., retains its effectiveness) after 35 days at 107° C., and has a consistent autoignition temperature of about 160° C. (+/−5° C.) during bonfire or slow cook-off tests. Thus, the AIP compositions of the present invention are chlorate-free and, moreover, exhibit decreased sensitivity, improved stability, and compatibility characteristics not displayed by chlorate-containing formulations.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of reducing autoignition temperature of a gas-generative inflator device comprising incorporating into the device an autoignition pill (AIP) composition which comprises azodiformamidine dinitrate (ADFD) in the absence of an alkali or alkaline earth metal chlorate.

2. The method of claim 1, which further comprises an oxidizer and an ignition accelerator/augmentor.

3. The method of claim 2, wherein the ADFD is present in an amount based on the total composition weight, of between about 60–75 wt. %.

4. The method of claim 3, wherein the oxidizer includes a perchlorate, a nitrate or a mixture thereof.

5. The method of claim 4, wherein the oxidizer is present in an amount between 20–30 wt. %.

6. The method of claim 4, wherein the oxidizer is a mixture of ammonium perchlorate and sodium nitrate.

7. The method of claim 6, wherein each of the ammonium perchlorate and sodium nitrate is present in an amount of between about 10–15 wt. %.

8. The method of claim 7, wherein the ammonium perchlorate is present in an amount of about 14 wt. % and the sodium nitrate is present in an amount of about 10 wt. %.

9. The method of claim 2, wherein the ignition accelerator/augmentor includes a powdered metal or metal oxide.

10. The method of claim 9, wherein the ignition accelerator/augmentor is present in an amount, based on the total composition weight, of between about 3–10 wt. %.

11. The method of claim 9, wherein the ignition accelerator/augmentor is at least one selected from the group consisting of iron oxide, copper oxide, magnesium, aluminum, tungsten, titanium, zirconium and hafnium.

12. The method of claim 2, wherein the ignition accelerator/augmentor includes boron potassium nitrate.

13. The method of claim 2, which further comprises a polymeric binder.

14. The method of claim 13, wherein the polymeric binder includes a poly(alkylene carbonate).

15. The method of claim 13, wherein the polymeric binder includes poly(propylene carbonate), poly(ethylene carbonate) or mixtures thereof.

16. A method of reducing autoignition temperature of a gas-generative inflator device comprising incorporating into the device a solid autoignition pill (AIP) composition comprised of a mixture of (A) azodiformamidine dinitrate, (B) ammonium perchlorate, (C) sodium nitrate, (D) an iron oxide powder and (E) a binder material.

17. The method of claim 16, wherein the components are present in the following amounts, based on the total composition weight:

(A) between about 60–75 wt. %;

(B) between about 10–15 wt. %;

(C) between about 10–15 wt. %;

(D) between about 3–10 wt. %; and (E) balance.

18. The method of claim 17, wherein the polymeric binder includes a poly(alkylene carbonate).

19. The method of claim 17, wherein the polymeric binder includes poly(propylene carbonate), poly(ethylene carbonate) or mixtures thereof.

20. A method of reducing autoignition temperature of a gas-generative inflator device comprising incorporating into the device a solid autoignition pill (AIP) comprising a mixture, based on total composition weight, of (A) about 69.46 wt. % azodiformamidine dinitrate, (B) about 13.85 wt.

% ammonium perchlorate, (C) about 10.03 wt. % sodium nitrate, (D) about 4.76 wt. % of an iron oxide powder and (E) about 1.90 wt. % of a binder.

21. The method of claim 20, wherein the polymeric binder includes a poly(alkylene carbonate).

22. The method of claim 20, wherein the polymeric binder includes poly(propylene carbonate), poly(ethylene carbonate) or mixtures thereof.

* * * * *